US006281915B1

(12) United States Patent
Shimada et al.

(10) Patent No.: US 6,281,915 B1
(45) Date of Patent: Aug. 28, 2001

(54) APPARATUS FOR PROPELLING TONER THROUGH APERTURES TO FORM IMAGES ON A RECORDING MEDIUM

(75) Inventors: Hirokatsu Shimada, Machida; Toshio Yamaki, Takatsuki; Koji Uno, Kobe; Yoshifumi Shibata; Hiroshi Hiraguchi, both of Toyokawa, all of (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/265,304

(22) Filed: Mar. 9, 1999

(30) Foreign Application Priority Data

Mar. 9, 1998 (JP) ..... 10-056616

(51) Int. Cl.[7] ..... B41J 2/06
(52) U.S. Cl. ..... 347/55
(58) Field of Search ..... 347/55, 151, 120, 347/141, 154, 103, 123, 111, 159, 127, 128, 131, 125, 158, 56; 399/271, 290, 293, 294, 295

(56) References Cited

U.S. PATENT DOCUMENTS 5,477,250 12/1995 Larson ..... 347/55
6,017,116 * 1/2000 Larson ..... 347/55

* cited by examiner

*Primary Examiner*—John Barlow
*Assistant Examiner*—Raquel Yvette Gordon
(74) *Attorney, Agent, or Firm*—Morrison & Foerster LLP

(57) ABSTRACT

A recording apparatus of the present invention includes a bearing member for bearing a recording medium having toner and carrier and a backing electrode opposing to the bearing member for electrically attracting the toner on the bearing member. The toner and carrier are charged to opposite polarities. A substrate having a plurality of apertures is provided between the bearing member and the backing electrode. This allows the toner to propel from the bearing member toward the backing electrode. Further, both the toner and carrier have respective volume mean diameters smaller than a diameter of the apertures, and the volume mean diameter of the toner is larger than that of the toner. With the arrangement, the toner will propel through each aperture to form a corresponding image portion, i.e., dot, thereby forming a high quality image without any dot-defect.

3 Claims, 2 Drawing Sheets

APPARATUS FOR PROPELLING TONER THROUGH APERTURES TO FORM IMAGES ON A RECORDING MEDIUM

RELATED APPLICATION

This application is based upon the Japanese Patent Application No. 10-056616, the content of which is incorporated herein by reference.

FIELD OF THE INVENTION

The present invention relates to an apparatus for propelling toner onto a recording medium such as paper to form images thereon. In particular, the present invention relates to an apparatus, using a recording material having toner and carrier, for propelling toner of the recording material to form images on the recording medium.

BACKGROUND OF THE INVENTION

Conventionally, there has been proposed one recording device for forming images on a recording medium such as paper. The device employs a recording material in the form of powder, made of toner and carrier. Typically, a particle size of the carrier is greater than that of toner. The device includes a bearing member for bearing the recording material, a backing electrode spaced a distance from the recording material born on the bearing member, and a substrate lying between the bearing member and the backing electrode. The substrate is formed with apertures through which the toner can pass and is provided with a plurality of individual electrode, each of which individual electrodes surrounding the aperture.

In such recording device, the toner and carrier are charged with opposite polarities by the contact with each other. In operation, a voltage having a polarity different from that of the toner is applied to the backing electrode, which forms an electric field for forcing the toner toward the backing electrode. An intensity of the electric field is not sufficient for the toner to separate from the carrier retaining the toner electrically.

In this state, once a voltage having a polarity different from that of the toner is biased to the selected individual electrode, the electric field is enhanced in the vicinity of the biased individual electrode. This enhancement of the electric field allows a part of toner opposing to the biased individual electrode to separate from the carrier and then propel toward the backing electrode through the corresponding aperture. Then, the toner passed through the aperture adheres onto a recording medium such as paper running between the plate and the backing electrode.

With this arrangement, the carrier made of magnetic material is normally held on the bearing member by a magnetic force generated between the carrier and the bearing member, though; a small amount of it can separate from the bearing member to drop onto the plate due to mechanical and electrical vibration, for example. Particularly, where the bearing member is supported above the backing electrode, more carrier will drop from the bearing member onto the substrate with the aid of the gravity applied thereto. Disadvantageously, the carrier on the plate may block the apertures due to its particle size that is greater than aperture. Eventually, this prevents the toner particles from the toner particles from being propelled through the blocked apertures, resulting in dot- defects degrading the resultant images.

SUMMARY OF THE INVENTION

To overcome this problem, a recording apparatus of the present invention includes a bearing member for bearing a recording medium having toner and carrier and a backing electrode opposing to the bearing member for electrically attracting the toner on the bearing member. The toner and carrier are charged to opposite polarities. A substrate having a plurality of apertures is provided between the bearing member and the backing electrode. This allows the toner to propel from the bearing member toward the backing electrode. Further, both the toner and carrier have respective volume mean diameters smaller than a diameter of the apertures, and the volume mean diameter of the carrier is larger than that of the toner.

In another aspect of the present invention, the carrier has more than about 70 percent of carrier particles having smaller diameter than the diameter of the apertures.

Also, in another aspect of the present invention, the substrate further has a plurality of control electrodes corresponding to the apertures, respectively, each of the control electrodes being for controlling the travel of the toner from the bearing member toward the backing electrode through one of the apertures.

DETAILED DESCRIPTION OF THE PREFERRED EMBODIMENTS

Figure 1:
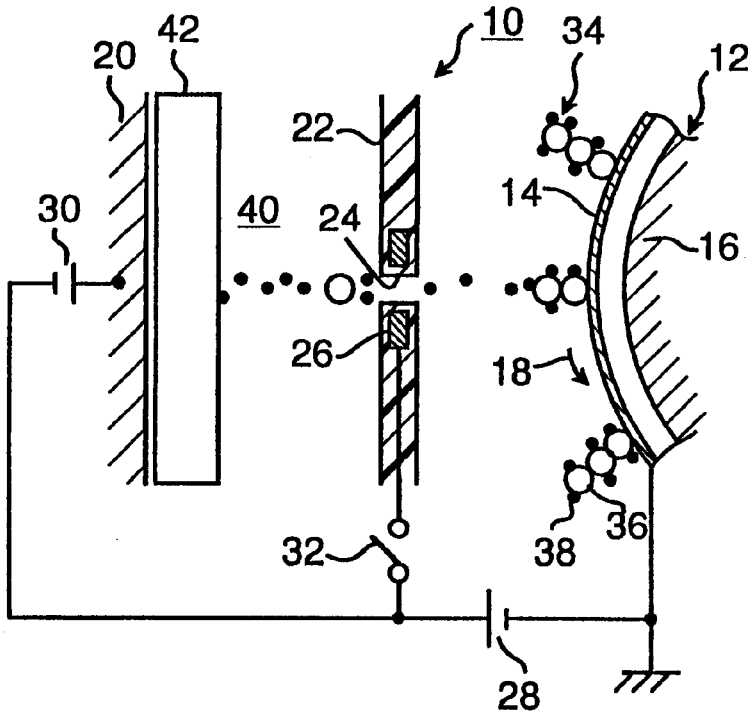
FIG. 1 is a schematic partial cross-sectional view of a recording station of a recording device of the present invention, showing that carrier particles having a smaller diameter than the aperture in the substrate traveling through the aperture.

With reference to the drawings, descriptions will be made to an embodiment of the present invention. FIG. 1 illustrates a simplified construction of a recording station of a recording device 10 of the present invention for use in an image forming apparatus such as printer, copy machine, and facsimile. The recording device 10 has a transporting member or bearing member generally indicated by the reference numeral 12. The bearing member 12 includes a cylindrical member or sleeve 14 made of electrically conductive material and a magnetic member 16 supported in the sleeve 12. The magnetic member 16 is unrotatably fixed. On the other hand, the sleeve 14 is supported for rotation and drivingly connected to a motor not shown, so that by the driving of the motor the sleeve 14 rotates in the direction indicated by an arrow 18.

A backing or common electrode indicated by the reference numeral 20, made of electrically conductive material, is opposed to the bearing member, leaving a certain gap from the bearing member. Also, a substrate or plate indicated by the reference numeral 22, preferably made from an insulating sheet, is arranged between the bearing member 12 and the backing. electrode 20. In a region where the sleeve 14 confronts to the backing electrode 20 leaving a minimum gap from the backing electrode, the plate 22 includes equally spaced plural apertures 24 positioned on a line extending in parallel to a rotational axis (not shown) of the sleeve 14. The plate 22 further includes plural ring-like individual electrodes or control electrodes 26, each of which electrode surrounds the associated aperture.

As shown in FIG. 1, the sleeve 14 is grounded. Also, the sleeve 14 and the backing electrode 28 are electrically connected through serially arranged two power supplies, 28 and 30, so that the backing electrode 20 is relatively biased to positive polarity relative to the sleeve 14. Each individual electrode 26 is electrically connected to a mid-portion of a line connecting two power supplies, 28 and 30, through an associated switch 32 so that it is biased to positive polarity by turning on the switch 32.

The sleeve 14 supports on its peripheral surface a recording material 34 in the form of thinned layer. The recording material 34 is a mixture of carrier 36 made of magnetic particles and toner 38 made of non-magnetic particles. The carrier and toner, 36 and 38, are selected so that they would be charged to opposite polarities by the contact with each other. In this embodiment, assume that the carrier is charged to positive polarity and the toner is charged to negative polarity by the mutual contact.

This allows the carrier 36 of magnetic particles to be retained on the sleeve 14 by the magnetic force generated between the carrier and the magnetic member 16. The toner 38, on the other hand, is held on the carrier particles 36 by an electrical attraction force generated between toner and carrier.

The carrier 38 is selected so that a volume mean diameter of the carrier is smaller than the diameter of the aperture 24. Preferably, the carrier has more than about 70 percent of the carrier particles being smaller in diameter than that of the aperture 24. The toner particles 38 are considerably smaller than the carrier particles 36 relative to the aperture 24, so that they can pass the aperture without any difficulty.

In operation of the recording device 10 so constructed, the recording material 34 is transported by the rotation of the sleeve 14 in the direction indicated by arrow 18. The transported recording material 34, when being passed through a region between the sleeve 14 and the backing electrode 20, is electrically attracted toward the backing electrode 20 due to the electric field formed between the sleeve 14 and the backing electrode 20. This attraction applied to the recording material 34 is not sufficient for the toner 38 to separate from the carrier 36, so that the toner 38 is retained on the carrier particles 36.

When the switch 32 is turned on in accordance with an image signal for forming an image, a pulse having positive polarity relative to the sleeve 32 is applied to the individual electrode 26. This enhances the intensity of the electric field between the individual electrode 26 and the sleeve 14. As a result, a part of toner 38 retained on the sleeve 14 and confronting to the biased individual electrode 26 is separated from the carrier particles 36 and then propelled through the corresponding aperture 24. Finally, the propelled toner 38 is deposited on the recording medium 42 being transported through a passage 40 between the backing electrode 20 and the plate 22.

Figure 2:
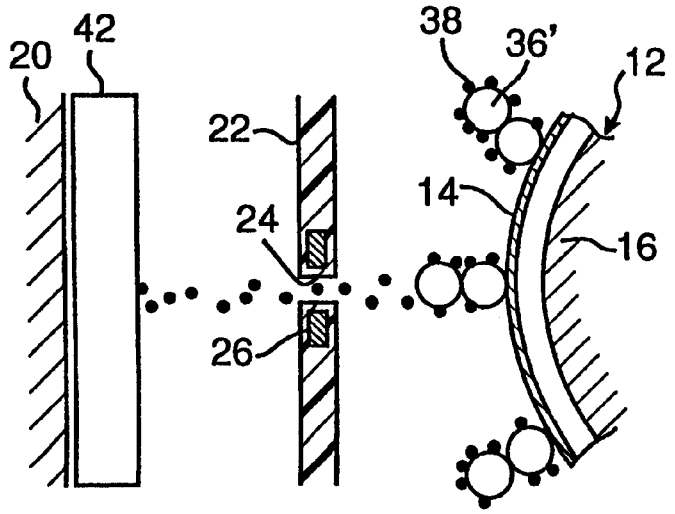
FIG. 2 is a schematic partial cross-sectional view of a recording station of a recording device as shown in FIG. 1, showing carrier particles having a larger diameter than the aperture in the substrate that do not pass through the aperture.
Figure 3:
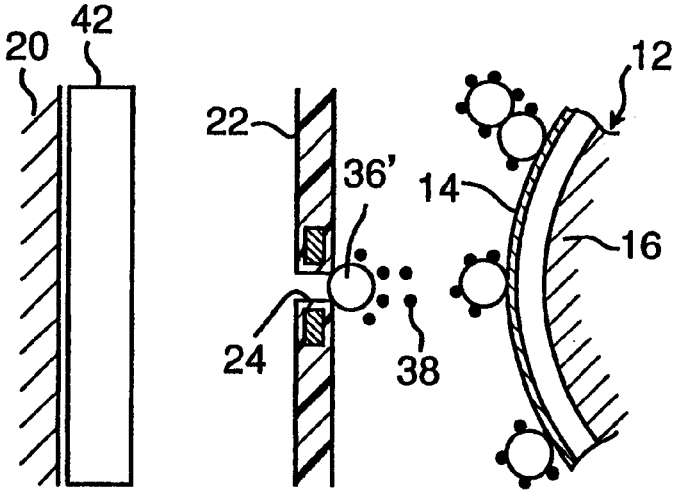
FIG. 3 is a schematic partial cross-sectional view of a recording station of a recording device shown in FIG. 2, illustrating the blocking of an aperture in the substrate by carrier particles having a greater diameter than the aperture.

Typically, the carrier particles 36 are retained on the sleeve 14 by the magnetic attraction force of the magnetic member 16. Unfortunately and disadvantageously, it is unavoidable that a small amount of carrier particles 36 may separate from the sleeve 14 due to some factors such as mechanical or electrical vibration and gravity. In this instance, as shown in FIGS. 2 and 3, where the particle of the carrier 36' is larger than the diameter of the aperture 24, it would block the aperture 24. However, the volume mean diameter of the carrier 36 employed in this embodiment is selected to be smaller than the diameter of the aperture 24. This allows almost all the particles of the carrier 36 to pass through the aperture 24 without being caught by the aperture, preventing the aperture 24 from being blocked by the carrier particles 36. This further ensures that the toner 38 will propel through each aperture to form a corresponding image portion, i.e., dot, thereby forming a high quality image without any dot-defect. In addition, this reduces a frequency of cleaning and maintenance of the plate 22.

Experiments were conducted for several carriers having different volume mean diameters with respect to the blocking of the apertures as well as the resultant dot-defects derived from the aperture blocking. Specifically, prepared was a toner having a volume mean diameter of 8$\mu$m. Also prepared were four carriers, having respective volume mean diameters ($d_{v1}$, $d_{v2}$, $d_{v3}$, $d_{v4}$). (see Table 1) Also, each carrier had an individual percentage content (PT) of particles having a volume mean diameter of equal to or more than 100 $\mu$m. (also see Table 1) The volume mean diameters of the toner and carrier particles were measured by Coulter Multisizer II available from Coulter Electronics Inc. The employed carrier and toner had charging characteristics that, by the contact with each other, the carrier being positively charged and the toner being negatively charged.

TABLE 1

| Carrier | $d_{vi}$ ($\mu$m) | PT (%) |
|---|---|---|
| 1 | 120 | 76 |
| 2 | 100 | 51 |
| 3 | 90 | 32 |
| 4 | 85 | 21 |

The recording device was designed that a distance between the sleeve and the individual electrode was 80 $\mu$m and the diameter ($d_a$) of each aperture was 100 $\mu$m. The apertures were formed in the substrate along six parallel lines each extending in parallel to the rotational axis of the sleeve with 2,480 apertures equally spaced in each line.

In each experiment, at printing, the individual electrode was applied with pulses for propelling the toner. The applied pulse voltage had a peak voltage of +350V relative to the sleeve, a pulse recurrence time of 1,600 $\mu$sec, and a pulse duration of 900 $\mu$sec. At non-printing, no voltage was applied to the individual electrodes. The backing electrode was biased to +1,300V at printing as well as non-printing.

Under such condition, an image having a printing ratio, i.e., [(printed area)/(printable area of recording medium)], of 5% was reproduced successively. The number of dot-defect was counted using a microscope for the 1st, 100th, and 1,000th pages of recorded sheets. The result is shown in the following table 2:

TABLE 2

| Printed Page | Carrier | | | |
|---|---|---|---|---|
| Number | 1 | 2 | 3 | 4 |
| 1 | C | A | A | A |
| 100 | — | A | A | A |
| 1,000 | — | B | B | A |

A: No dot-defect was detected.
B: Several dot-defects were detected.
C: More than several tens of dot-defects were detected.

As the table shows that, for the first carrier having the volume mean diameter $d_{v1}$ of 120 $\mu$m ($d_{v1}>d_a$), a number of dot-defects were detected on the 1st page. On the other hand, for second carrier having the volume mean diameter $d_{v1}$ of 100 $\mu$m ($d_{v2}=d_a$) and third carrier having the volume mean diameter of 90 $\mu$m ($d_{v3}<d_a$), no dot-defect was detected on the 100th sheets and several dot-defects were observed on the 1,000th sheets; however, this was not problematic, practically. Also, for fourth carrier having minimum volume mean diameter $d_{v4}$ of 85 $\mu$m, no dot-defect was observed.

The invention has been described in detail with particular reference to certain preferred embodiment thereof, but it will be understood that variations and modifications can be effected within the spirit and scope of the invention.

What is claimed is:

1. An apparatus for recording images on a recording medium, comprising:

a bearing member for bearing a recording medium having toner and carrier, said toner and carrier being charged to opposite polarities;

a backing electrode opposing said bearing member for electrically attracting said toner on said bearing member; and a substrate provided between said bearing member and said backing electrode, said substrate having a plurality of apertures through each of which said toner can travel from said bearing member toward said backing electrode, wherein both said toner and carrier have respective volume mean diameters smaller than a diameter of said apertures, and said volume mean diameter of said carrier is larger than that of said toner.

2. An apparatus in accordance with claim 1, wherein said carrier comprise more than about 70 percent of carrier particles having a smaller diameter than said diameter of said apertures.

3. An apparatus in accordance with claim 1, wherein said substrate further has a plurality of control electrodes corresponding to said apertures, respectively, each of said control electrodes being for controlling the travel of said toner from said bearing member toward said backing electrode through one of said apertures.

* * * * *

UNITED STATES PATENT AND TRADEMARK OFFICE

CERTIFICATE OF CORRECTION

PATENT NO. : 6,281,915 B1
DATED : August 28, 2001
INVENTOR(S) : Hirokatsu Shimada et al.

It is certified that error appears in the above-identified patent and that said Letters Patent is hereby corrected as shown below:

Title page,
Item [73], Assignee, add -- Array Printers AB, Vastra Frolunda, Sweden. --

Signed and Sealed this

Twenty-third Day of April, 2002

*Attest:*

*Attesting Officer*

JAMES E. ROGAN
*Director of the United States Patent and Trademark Office*